United States Patent [19]

Fogle et al.

[11] 4,171,387

[45] Oct. 16, 1979

[54] COATING WOOD SUBSTRATES

[75] Inventors: Ozzie Fogle; James Cooley, both of Orangeburg, S.C.

[73] Assignee: Champion International Corporation, Stamford, Conn.

[21] Appl. No.: 875,419

[22] Filed: Feb. 6, 1978

[51] Int. Cl.[2] ..... B05D 3/06; B05D 5/10

[52] U.S. Cl. ..... 427/54; 156/272; 156/327; 427/207 D; 427/393; 427/381; 427/394; 427/397; 427/408; 427/428; 428/424

[58] Field of Search ..... 427/394, 54, 397, 407 D, 427/207 D, 408, 428, 393, 381; 156/272, 327; 428/424, 425

[56] References Cited

U.S. PATENT DOCUMENTS

| | | | |
|---|---|---|---|
| 3,676,283 | 7/1972 | Kehr et al. | 428/424 X |
| 3,687,801 | 8/1972 | Derby | 428/424 X |
| 3,948,666 | 4/1976 | Kitanishi et al. | 428/424 X |
| 3,959,521 | 5/1976 | Suetsugi et al. | 427/44 |
| 4,018,939 | 4/1977 | Merrill et al. | 427/54 |
| 4,039,517 | 8/1977 | Hamamura et al. | 428/425 X |

*Primary Examiner*—Michael F. Esposito
*Assistant Examiner*—Thurman K. Page
*Attorney, Agent, or Firm*—Evelyn M. Sommer

[57] ABSTRACT

A cellulosic substrate is coated by applying a polyurethane adhesive thereto, drying the adhesive, coating the adhesive with an ultraviolet curable solid polyacrylate resin and then curing the composite structure with ultraviolet rays.

6 Claims, No Drawings

COATING WOOD SUBSTRATES

BACKGROUND OF THE INVENTION

This invention relates to new coated cellulosic substrates and more particularly to new coated cellulosic substrates for decorative and other purposes and to a method for making such coated substrates.

Cellulosic substrates are often coated with resinous coatings for decorative and other purposes. Since the cellulosic substrates are heat-sensitive, the resinous coatings are often cured by a photoinitiation or ultraviolet radiation process. However, many resinous coatings do not have a satisfactory adhesion to the wide variety of cellulosic substrates and those coatings which exhibit satisfactory adhesion often have insufficient impact resistance.

Accordingly, it is the object of this invention to provide a new method for adhering an ultraviolet coating to a variety of cellulosic substrates to provide a product which exhibits excellent adhesion of the coating to the substrate and also exhibits excellent impact resistance. This and other objects of the invention will become apparent to those skilled in the art from the following detailed description.

SUMMARY OF THE INVENTION

This invention relates to new coated cellulosic substrates for decorative and other purposes and the manner in which such coated substrates can be prepared. More particularly, the new coated substrates are prepared by applying a polyurethane adhesive to the cellulosic substrate, drying the adhesive, applying an ultraviolet curable topcoat to the dried adhesive and thereafter curing the composite structure with ultraviolet radiation.

DESCRIPTION OF THE INVENTION

The instant invention is applicable to a wide variety of cellulosic substrates. Suitable wood or wood product substrates include such diverse materials as plywood, composition board such as particle board, chipboard, and the like, lauan, hardboard, etc.

A polyurethane adhesive is applied to the substrate by conventional techniques such as spraying, doctoring, rolling, brushing and the like, and the adhesive is then dried. In general, the adhesive is applied to provide a wet thickness of about 1–5 mils, and preferably about 2–3 mils. Although the adhesive can be applied in a single coating procedure, it is preferred to apply a first layer of the adhesive followed by drying and then applying a second layer of adhesive followed by drying to produce the adhesive coated substrate.

The urethane adhesive applied to the substrate is a solution or suspension of a urethane polymer in an inert solvent. The urethane resins employed are the well known reaction products of a polyisocyanate and an active hydrogen containing compound. Various organic polyisocyanates can be used in preparing the urethane resin. Among these isocyanates are 2,4-toluene diisocyanate, 2,6-toluene diisocyanate, and mixtures thereof, particularly the crude mixtures thereof that are commercially available. Other typical polyisocyanates include methylene bis(4-phenyl) isocyanate, n-hexyl diisocyanate, 1,5-naphthalene diisocyanate, 1,3-cyclopentylene diisocyanate, p-phenylene diisocyanate, 2,4,6-toluene triisocyanate, 4,4',4''-triphenylmethyl triisocyanate, polyaryl polyisocyanates such as polymethylene polyphenyl polyisocyanate, and the like. Suitable active hydrogen containing compounds include polyols such as ethylene glycol, diethylene glycol, propylene glycol, trimethylol propane, neopentyl glycol, 2,2,4-trimethyl-1,3-pentanediol, glycerol, hexanetriol, butanetriol, pentaerythritol, mannitol, and the like, hydroxyl group containing polymers, and the like.

The urethane adhesives as used herein preferably have a viscosity of 800–2500 cps and a hardness of durometer A-65-110.

Suitable inert solvents include the alkanes such as hexane, octane and the like, aromatic hydrocarbons such as toluene and xylene, esters of a carboxylic compound and an alcohol such as ethylene glycol monoethyl ether acetate, ketones such as acetone and methylethyl ketone, chlorinated hydrocarbons such as trichloroethylene, and the like, and the like solvents. The solvent is employed in an amount sufficient to provide a urethane adhesive coating composition containing 25 to 35% solids.

In the next step of the instant process, i.e. after drying of the adhesive layer, an ultraviolet curable solid polyacrylate resin composition is applied to the adhesive coated substrate. The polyacrylate composition contains about 77 to 89% of a solid polyacrylate resin, about 10 to 20% of a silica pigment, and about 1 to 3% of a photoinitiator.

The polyacrylate resin is a polymer of acrylate acid and its derivatives. Thus, the resin can be selected from polyacrylic acid and its esters and typical compounds include polyacrylic acid, polymethacrylic acid, poly(methyl acrylate), poly(ethyl acrylate), poly(butyl acrylate), poly(n-hexyl acrylate), poly(benzyl acrylate) poly(cyclohexyl acrylate), poly(phenylethyl acrylate), poly(chloro acrylate), poly(methyl methacrylate), poly(ethyl methacrylate), poly(ethylene methacrylate), and the like.

The polyacrylate resin preferably has a viscosity ranging from 300–1200 cps.

Any of the known photoinitiators can be used in the polyacrylate composition. Typical examples include benzoin and benzoin ethers such as benzoin methyl ether, benzoin ethyl ether and benzoin isopropyl ether. The solid polyacrylate, silica pigment and photoinitiator can be blended in any convenient manner and coated on the adhesive by conventional techniques. In general, the thickness of the polyacrylate coating will be about 0.1–5 mils and preferably about 2–3 mils.

The composite structure is then subjected to sufficient ultraviolet radiation to cure the topcoat.

In a particularly preferred embodiment, the coated cellulosic substrate is formed in a continuous coating procedure. In this procedure, the substrate is continuously conveyed through several zones of a coating line. In the first zone, about one-half of the desired amount of urethane adhesive is direct roller coated on the substrate and in the second zone the coated substrate is subjected to an elevated temperature of, for example, 100°–350° F., preferably about 250°–350° F. In the next two zones, a second application of urethane adhesive and drying of the second adhesive coat is effected in generally the same manner. In the next zone, the urethane adhesive is curtain coated or direct roller coated with the ultraviolet curable polyacrylate topcoat and then the composite structure is cured with ultraviolet lamps in the final zone.

A urethane adhesive resin was prepared by dissolving the resin in a 50—50 blend of MEK and toluene to provide a solution having a 25-35% solids content. A particleboard substrate was continuously conveyed through several zones in a coating line. In the first zone, the urethane adhesive composition was direct roller coated on the substrate at an application rate of 1-1.5 wet mils thickness. The second zone was a 30 foot long oven maintained at a temperature of 250°-350° F. through which the coated substrate was conveyed at a speed of 100 ft. per minute in order to dry the first coat. In a third zone, the substrate was direct roller coated with an additional 1-1.5 wet mils thick coating of the urethane adhesive and in a fourth zone which was a 40 foot long oven maintained at 250°-350° F. the coated substrate was conveyed through at a speed of 100 ft. per minute. The coated substrate was then passed through a fifth zone in which an ultraviolet curable polyacrylate composition was curtain coated onto the urethane adhesive. The ultraviolet curable polyacrylate used was Racron 400 prepared by PPG. The thickness of the coating was about 2 mils. Finally, this coated substrate was conveyed through an oven containing a series of 10 ultraviolet lamps (200 watt/ sq. in.) at a speed of 125 ft. per minute. The resulting substrate exhibited an excellent adhesion of the polyacrylate coating to the wood substrate and excellent impact resistance.

A Cross Hatch adhesion test indicated no failure as compared with failure without the urethane undercoat. The Hoffman Scratch Tests exhibited no failure at 2500 gms. as compared to failure at 500 gms without the urethane undercoat.

Various changes and modifications can be made in the process and product of this invention without departing from the spirit and scope thereof. The embodiments set forth herein were for the purpose of illustrating the invention but were not intended to limit it.

What is claimed is:

1. A method of forming a coated substrate selected from the group consisting of plywood, composition board, lauan and hardboard, which comprises applying to said substrate a urethane adhesive having about 25-35% solids content, drying said adhesive, applying on to said adhesive an ultraviolet curable polyacrylate resin composition comprising about 77-89% solid polyacrylate resin, about 10-20% silica pigment and about 1-3% photo-initiator, and thereafter curing the composite resulting structure by exposure thereof to ultraviolet radiation.

2. The method of claim 1 wherein said urethane adhesive is applied at a rate such as to provide about 1-5 wet mils of urethane adhesive on said substrate.

3. The method of claim 2 wherein said rate is that required to produce about 2-3 wet mils.

4. The method of claim 3 wherein said adhesive is applied to said substrate in at least two separate applications and after each application, the coated adhesive is dried.

5. The method of claim 4 wherein said steps are carried out in a continuous sequence.

6. The method of claim 1 wherein said urethane adhesive has a viscosity of 800-2500 cps and said polyacrylate resin has a viscosity of from 300-1200 cps.

* * * * *